US007068966B2

(12) United States Patent
Shinohara et al.

(10) Patent No.: US 7,068,966 B2
(45) Date of Patent: Jun. 27, 2006

(54) IMAGE FORMING APPARATUS OPERABLE IN TWO IMAGE FORMATION MODES USING EITHER ONE DEVELOPING DEVICE OR A PLURALITY OF DEVELOPING DEVICES

(75) Inventors: Seiichi Shinohara, Mishima (JP); Hiroshi Sato, Shizuoka-ken (JP); Syuhei Kawasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/775,082

(22) Filed: Feb. 11, 2004

(65) Prior Publication Data

US 2004/0223787 A1 Nov. 11, 2004

(30) Foreign Application Priority Data

Feb. 14, 2003 (JP) ..... 2003/036680

(51) Int. Cl.
*G03G 15/01* (2006.01)

(52) U.S. Cl. ..... 399/227; 399/228

(58) Field of Classification Search ..... 399/85, 399/223, 226, 227, 228
See application file for complete search history.

(56) References Cited

U.S. PATENT DOCUMENTS

| | | | | |
|---|---|---|---|---|
| 4,922,301 | A | 5/1990 | Katoh et al. | |
| 5,294,967 | A * | 3/1994 | Munakata et al. | 399/227 |
| 5,640,654 | A * | 6/1997 | Yoshizawa | 399/227 |
| 5,797,069 | A * | 8/1998 | Kimura et al. | 399/223 X |
| 5,826,146 | A * | 10/1998 | Maruta et al. | 399/227 X |
| 5,887,227 | A | 3/1999 | Kawai et al. | 399/98 |
| 5,918,092 | A * | 6/1999 | Hama | 399/227 |
| 5,991,580 | A * | 11/1999 | Byeon | 399/227 |
| 6,201,939 | B1 * | 3/2001 | Yamamoto et al. | 399/227 X |
| 6,535,707 | B1 * | 3/2003 | Maruta et al. | 399/227 |
| 2003/0128997 | A1 | 7/2003 | Sakaizawa et al. | 399/55 |
| 2003/0133719 | A1 | 7/2003 | Tsuruya et al. | 399/12 |

FOREIGN PATENT DOCUMENTS

| | | |
|---|---|---|
| JP | 62-251772 | 2/1987 |
| JP | 11-167276 | 6/1999 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes an image bearing member; a plurality of developing devices for developing electrostatic images formed on the image bearing member with developers, the developing devices including respective developer carrying members for carrying respective developers; moving devices for moving a selected one of the developing devices to an operative position, wherein each of the developer carrying members is movable selectively to be in contact with or spaced from the image bearing member at the operative position. The apparatus is operable in a first image formation mode in which an image is formed using the plurality of developing devices and a second image formation mode in which an image is formed using one of the plurality of developing devices. The developer carrying member which is at the operative position in the first image formation mode is capable of being spaced from the image bearing member by a first distance during non-developing-operation. The developer carrying member which is at the operative position in the second image formation mode is capable of being spaced from the image bearing member by a second distance during non-developing-operation, wherein the second distance is smaller than the first distance.

21 Claims, 7 Drawing Sheets

IMAGE FORMING APPARATUS OPERABLE IN TWO IMAGE FORMATION MODES USING EITHER ONE DEVELOPING DEVICE OR A PLURALITY OF DEVELOPING DEVICES

FIELD OF THE INVENTION AND RELATED ART

The present invention relates to an image forming apparatus such as an electrophotographic apparatus, for example, a copying machine, a laser printer, etc. It also relates to an image forming apparatus such as an electrostatic recording apparatus.

In multicolor image formation, generally, a plurality of electrostatic latent images are sequentially formed on a photosensitive member as an image bearing member, in accordance with external data, and are sequentially developed with a plurality of developers different in color, one for one, into a plurality of images different in color (which hereinafter may be referred to as "toner images"). These toner images are transferred onto recording medium, for example, recording paper, sequentially or all at once to yield a multicolor image.

As for image developing apparatuses used for the above described multicolor image formation, developing apparatuses of the rotary type have been proposed or put to practical use, which use one of the so-called rotary developing methods. According to a typical rotary developing method, a plurality of developing apparatuses which contain, one for one, a plurality of developers, for example, black, yellow, magenta, and cyan, are mounted in a rotary (developing apparatus supporting rotatable member), along the circumference of the rotary, in order to allow the developing apparatuses to be sequentially moved to the development position in which the peripheral surface of one of the developing apparatuses is placed virtually or actually in contact with the peripheral surface of a photosensitive member to develop a latent image on the peripheral surface of the photosensitive member.

FIG. 8 shows a typical image forming apparatus employing a developing apparatus of the above described rotary type.

The image forming apparatus in FIG. 8 is a color image forming apparatus of the rotary type. It has a rotary (developing apparatus supporting rotatable member) 22*x*, in which a plurality of developing apparatuses 22*a*, 22*b*, 22*c*, and 22*d* are mounted. It also comprises: a photosensitive member (photosensitive drum) 1 as an image bearing member; a charge roller 2 as a charging means; an exposing apparatus 3 for imparting image formation data; a developing means 22 for developing the electrostatic latent image on the photosensitive drum 1 into a visible image; and an intermediary transfer member 24.

The rotary 22*x* is a part of the developing means 22. It holds a yellow developing apparatus 22*a*, a magenta developing apparatus 22*b*, a cyan developing apparatus 22*c*, and a black developing apparatus 22*d*, in this order, along the circumference of the rotary 22*x*, so that the developing apparatuses can be sequentially moved to the location at which the peripheral surface of the developer carrying member 8 of each developing apparatus can be placed in contact with the peripheral surface of the photosensitive drum 1 to form a toner image on the peripheral surface of the photosensitive drum 1. In the multicolor image formation, a plurality of toner images different in color are sequentially formed on the peripheral surface of the photosensitive drum 1 by rotating the rotary 22*x* as described above, and are sequentially transferred in layers onto the intermediary transfer member 24. Then the plurality of images layered on the intermediary transfer member 24 are transferred all at once onto transfer medium (recording medium) P, yielding thereby a full-color image on the recording medium P.

The color image forming apparatuses of the above described rotary type in accordance with the prior art have been disclosed in Japanese Laid-open Patent Application 62-251772, and the like.

In the case of the image forming apparatuses of the above described type, it is possible that such problems as the inaccuracy in the configuration of the rotational axle of the rotary, inaccuracy in the assembly of the rotary, and/or the like problems, will cause the image bearing member and developing means to come into contact with each other, causing damage, as the rotary is rotated. In order to prevent this problem, it is necessary to enable the developing means to be moved away from the image bearing member so that the developing means can be kept away from the image bearing member while an image is not formed, as disclosed in Japanese Laid-open Patent Application 11-167276.

However, in the case of the above described image forming apparatus in accordance with the prior art, even when the image forming apparatus is in the mode for continuously printing a plurality of monochromatic images, in other words, even when it is unnecessary to rotate the rotary, the rotary is linearly moved to keep the developer carrying member away from the image bearing member while no image is developed. This is a waste of time.

Obviously, a printing operation in which a plurality of monochromatic images are continuously formed, can be reduced in operation time by not linearly moving the developing means away from the image bearing member, that is, not separating the developer carrying member from the image bearing member, while an image is not formed. However, without moving the developing means away from the image bearing member, the image bearing member and developer carrying member always remain in contact with each other, causing thereby various problems; for example, the developer deteriorates, more specifically, the electrical charge of the developer attenuates, allowing the developer to fall and/or scatter from the developer carrying member.

Some of the image forming apparatuses of the above described rotary type comprise developer regulating members for regulating the amount by which the developer is allowed to remain on the peripheral surface of a developer carrying member, and means for applying bias to a developer carrying member and a developer regulating member. In the case of these image forming apparatuses, if the developer carrying member is not separated from the image bearing member while no image is formed, the developer sometimes transfers onto unintended points on the image bearing member, resulting in the formation of a foggy image, contamination of the transferring means and/or transfer medium P, and/or the like problems.

SUMMARY OF THE INVENTION

The primary object of the present invention is to provide an image forming apparatus substantially shorter in the image formation time compared to an image forming apparatus in accordance with the prior art.

Another object of the present invention is to provide an image forming apparatus structured so that while no image is developed, the developer carrying member is kept separated from the image bearing member in order to prevent the falling and/or scattering of the developer, and therefore, is capable of forming an excellent image.

Another object of the present invention is to provide an image forming apparatus structured so that when the image forming apparatus is in the mode in which only one of the plurality of the developing apparatuses is used for image formation, the developing apparatus is kept separated from the image bearing member while no image is developed.

Another object of the present invention is to provide an image forming apparatus, the developer carrying member(s) of which is separable from the image bearing member in order to prevent the image bearing member and developer carrying member(s) from becoming damaged due to the contact between the image bearing member and developer carrying member(s), when the developing apparatuses are moved while no image is developed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in accordance with the present invention will be described in detail with reference to the appended drawings.

Embodiment 1

Figure 1:
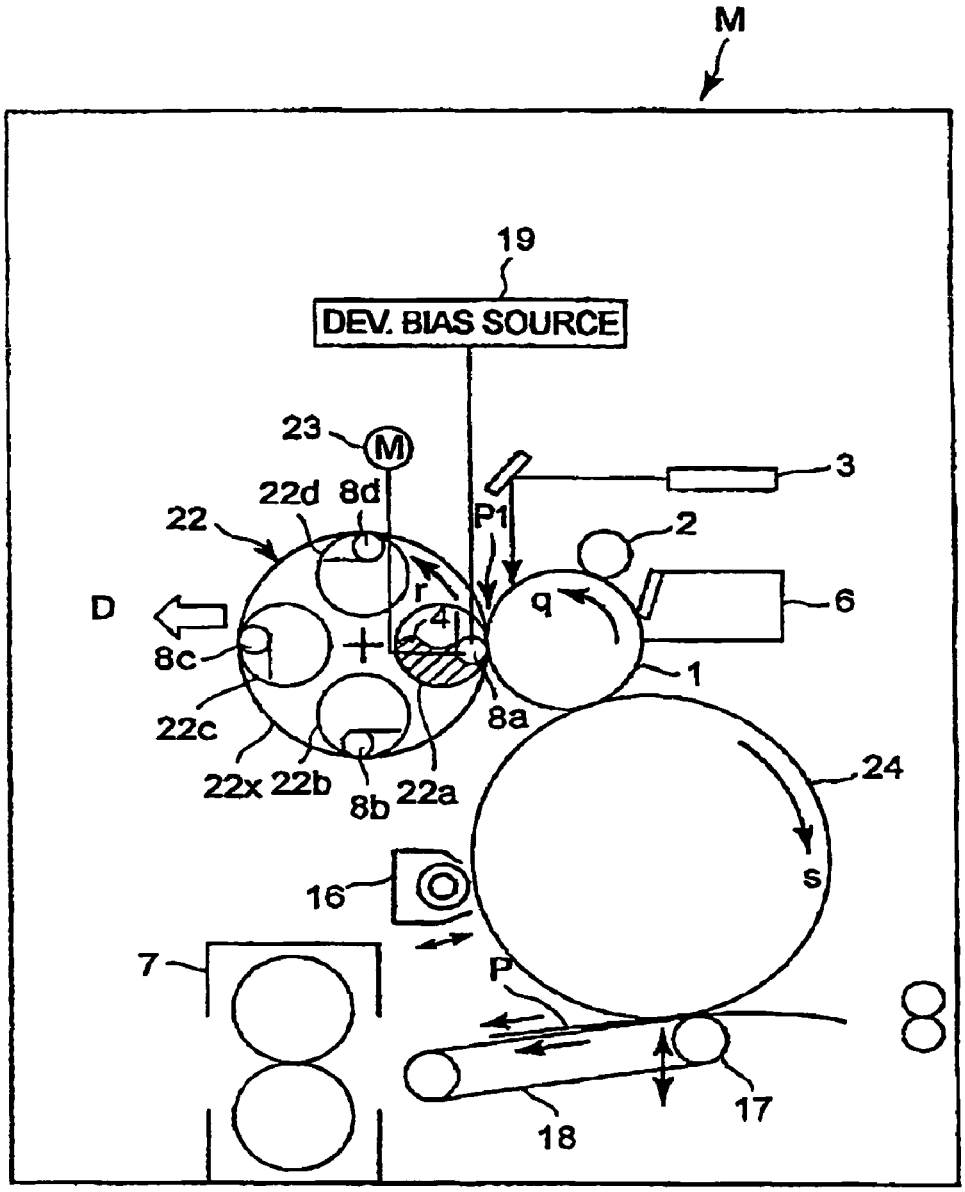
FIG. 1 is a schematic sectional view of the image forming apparatus in one of the preferred embodiments of the present invention, showing the general structure thereof.

FIG. 1 is a schematic sectional view of the image forming apparatus in this embodiment of the present invention. The image forming apparatus M in this embodiment is a so-called rotary type image forming apparatus, that is, an image forming apparatus employing a developing means 22 comprising: a rotary 22*x* capable of supporting a plurality of developing apparatuses; and a plurality of developing apparatuses 22*a*, 22*b*, 22*c*, and 22*d*, which contain, one for one, developers different in color, and are mounted in the rotary 22*x*, along the circumference of the rotary 22*x*. The image forming apparatus M also comprises: a photosensitive drum 1; a charge roller 2; as a charging means; an exposing apparatus 3 for emitting a beam of light in accordance with image formation data; the developing means 22 for developing an electrostatic latent image on the photosensitive drum 1; and an intermediary transfer member 24.

The developing means 22 comprises: a rotary 22*x* as a developing apparatus supporting rotary member, capable of supporting a plurality of developing apparatuses; and a plurality of developing apparatuses, more specifically, a yellow developing apparatus 22*a*, a magenta developing apparatus 22*b*, a cyan developing apparatus 22*c*, and a black developing apparatus 22*d*, which contain, one for one, toners 4 as developers, different in color, and are mounted in the rotary 22*x*.

As will be described next in more detail, the image forming apparatus M in this embodiment is an electrophotographic color printer. It separates the image formation data of an intended image from an unshown personal computer, workstation, or the like, into four sets of data corresponding to the four color components of the intended image, that is, yellow Y, magenta M, cyan C, and black Bk color components; sequentially forms a plurality of images of the developers (toners) different in color, based on the four sets of the data, one for one, with the use of the aforementioned image forming means; and transfers all at once in layers the formed toner images onto transfer medium (recording medium) P, yielding a full-color image.

Figure 2:
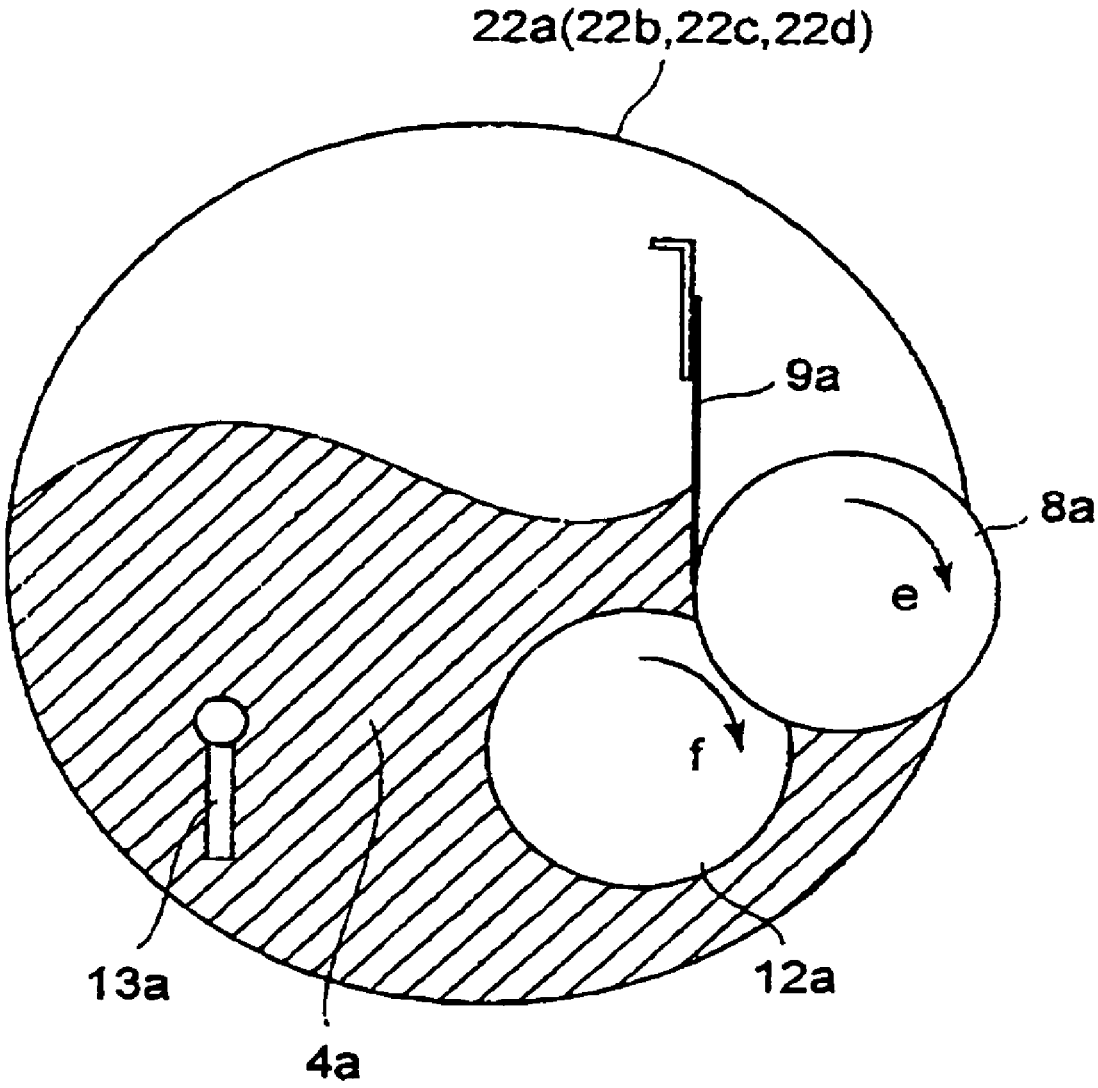
FIG. 2 is a schematic sectional view of a typical developing apparatus in accordance with the present invention, showing the general structure thereof.

FIG. 2 is a schematic sectional view of the developing apparatus 22*a* (22*b*, 22*c*, or 22*d*) of the developing means 22, containing yellow Y toner (magenta M, cyan C, or black Bk toner, respectively), showing the general structure thereof.

Hereinafter, in order to simplify the descriptions, the preferred embodiments of the present invention will be described with reference to only a single developing apparatus, or the yellow developing apparatus 22*a*. All the developing apparatuses 22*a*, 22*b*, 22*c*, and 22*d* are the same in structure, although they are different in the color of the toner they contain. Thus, the development roller of the developing apparatus 22*a* will be referred to as development roller 8*a*, and the development roller of the developing apparatus 22*b* will be referred to as development roller 8*b*, the development roller of the developing apparatus 22*c* will be referred to as development roller 8*c*, and the development roller of the developing apparatus 22*d* will be referred to as development roller 8*d*. In generic terms, the development rollers, development blades, etc., will be referred to as development roller 8, development blade 9, etc.; in other words, they will be referred to without an alphabetic suffix.

The developing apparatus 22*a* in FIG. 2 is a contact developing apparatus, which contains yellow toner Y, that is, nonmagnetic single-component toner, as developer, and the developer carrying member of which is placed in contact with the photosensitive drum 1 in order to develop a latent image on the photosensitive drum 1. With the employment of this type of a developing apparatus, highly precise development is possible. In this embodiment, the above described developing apparatus is employed. However, the present invention is also applicable to an image forming apparatus which employs a developing apparatus of a noncontact type, that is, a developing apparatus in which the developer carrying member and image bearing member are not placed in contact with each other. In other words, the present invention is also applicable to an image forming apparatus in which the developer carrying member and image bearing member are virtually in contact with each other. In this specification, "virtually in contact" will be also be referred to as "in contact".

The developing apparatus 22*a* comprises: a frame (container portion) in which the yellow toner 4*a* as developer is held; a development roller 8*a* as a developer carrying member, which is rotated in the direction indicated by an arrow mark e in the drawing, while carrying the developer on its peripheral surface, in order to convey the developer to the peripheral surface of the photosensitive drum 1 to develop a latent image on the peripheral surface of the photosensitive drum 1; a supply roller 12*a* as a toner supplying means, which is rotated in the direction indicated by an arrow mark f in the drawing to supply the development roller 8*a* with the toner; a development blade 9*a* as a member for regulating the amount by which the toner is left coated on the development roller 8*a* and the amount of the electrical charge to be given to the developer; and a stirring member 13*a* which stirs the toner while supplying the supply roller 12*a* with the toner.

The development roller 8*a* is placed in contact with the photosensitive drum 1. Therefore, the portion of the development roller 8*a*, which is actually placed in contact with the photosensitive drum 1, is desired to be formed of an elastic substance, such as rubber, capable of absorbing impact. The development blade 9*a* is formed of thin metallic plate, and is kept in contact with the development roller 8*a* by the elasticity of the thin metallic plate. As for examples of the material for the thin metallic plate, stainless steel, phosphor bronze, etc., are usable. In this embodiment, a piece of 0.1 mm thick phosphor bronze is employed.

The image forming apparatus in FIG. 1 structured as described has a full-color mode as the primary image formation mode and a monochromatic mode as the secondary image formation mode, which can be selected by a user. In the primary image formation mode, the plurality of the developing apparatuses 22*a*–22*d*, which contain one for one developers different in color, are structured as described above, and are mounted in the rotary 22*x*, are sequentially placed in contact with the photosensitive drum 1 by rotating the rotary 22*x*, in order to form a full-color image. In the secondary image formation mode, only one of the four developing apparatuses 22*a*, 22*b*, 22*c*, and 22*d* is used to form a monochromatic image. In other words, in the secondary image formation mode, the rotary 22*x* is not rotated.

First, the primary image formation process, which is carried out when the image forming apparatus is in the primary image formation mode, that is, the full-color mode, and in which the plurality of developing apparatuses are used, will be described.

The image forming apparatus M is provided with an organic photosensitive (photoconductive) drum 1 as an image bearing member. The photosensitive drum 1 is rotationally driven in the direction indicated by an arrow mark q in the drawing. The peripheral surface of this photosensitive drum 1 is uniformly charged to a predetermined potential level (dark potential level) by applying bias to the metallic core of the charge roller 2 as a contact charging means from an unshown bias applying means. The uniformly charged area of the peripheral surface of the photosensitive drum 1 is exposed to a beam of laser light which is projected in the oscillatory fashion from the exposing apparatus 3 in accordance with the image formation data for the first color component, or yellow color component. As a result, numerous points on the uniformly charged area of the peripheral surface of the photosensitive drum 1 are reduced in potential to a predetermined level (light potential level), forming thereby the first electrostatic static latent image.

The electrostatic latent image formed through the above described process is developed into a visible image by one of the above described developing apparatuses, shown in FIG. 2, mounted in the rotary 22*x* of the developing means 22. The rotary 22*x* is structured so that a first developing apparatus 22*a* which contains yellow toner (Y) as the toner of a first color, a second developing apparatus 22*b* which contains magenta (M) toner as the toner of a second color, a third developing apparatus 22*c* which contains cyan (C) toner as the toner of a third color, and a fourth developing apparatus 22*d* which contains black toner (Bk) as the toner of a fourth color, can be integrally held in the rotary 22*x*.

In the full-color image formation mode, during the so-called "color intervals", that is, the periods in which the development process is not carried out, in other words, no image is actually formed, the developing means 22 comprising essentially the rotary 22*x* and the plurality of the developing apparatuses 22*a*–22*d* held therein is moved away from the development position thereof, in the direction indicated by an arrow mark D in the drawing, to a predetermined location at which the rotary 22*x* is rotated in the direction indicated by an arrow mark r in the drawing to move a given developing apparatus, which in this case is the developing apparatus 22*a*, to the development position P1 in which the peripheral surface of the development roller 8*a* of the developing apparatus 22*a* is placed in contact with the peripheral surface of the photosensitive drum 1. Then, the rotary 22*x* is moved back toward the photosensitive drum 1, placing thereby the peripheral surface of the development roller 8*a* in contact with the peripheral surface of the photosensitive drum 1. Then, the development roller 8*a* as a developer carrying member, on which the toner is borne in a predetermined thickness, is rotationally driven by a motor 23. Then, a predetermined bias is applied to the metallic core of the development roller 8*a* from a development roller 8*a* from a development bias power source 19 to develop the first electrostatic latent image on the photosensitive drum 1. The development position of the developing means 22 is such a position in which the developing means 22 is positioned to place the peripheral surface of the development roller 8 of a given developing apparatus 22 in contact with the peripheral surface of the photosensitive drum 1, after the given developing apparatus is moved to the development position P1, the position in which the developing apparatus is closest to the photosensitive drum 1.

The first electrostatic latent image is developed into a visible image by the first developing apparatus 22*a* which contains yellow (Y) toner as the first toner. The developing method in this embodiment is a contact developing method in which an electrostatic latent image formed by exposure is developed in reversal with the use of nonmagnetic single-component toner which is high in sphericity. However, the application of the present invention is not limited to this developing method.

This visible image, that is, a toner formed of a first color, is electrostatically transferred (primary transfer) onto the surface of the intermediary transfer member 24, in the first transfer station, which is the nipping portion between the peripheral surface of the photosensitive drum 1 and the peripheral surface of the intermediary transfer member 24. The intermediary transfer member 24 comprises a cylinder, an electrically conductive elastic layer formed on the peripheral surface of the cylinder, and a surface layer formed on the peripheral surface of the elastic layer and having release properties.

The circumference of the intermediary transfer member 24 is greater than the length of the largest transfer medium usable with the image forming apparatus M. It is kept in contact with the photosensitive drum 1 with the application of a predetermined amount of pressure, and is rotationally driven in the direction (indicated by arrow mark s in FIG. 1, being therefore the same as a rotational direction of photosensitive drum 1, in nipping portion) opposite to the rotational direction of the photosensitive drum 1, at a peripheral velocity virtually the same as that of the photosensitive drum 1. The toner image on the peripheral surface of the photosensitive drum 1 is electrostatically transferred (primary transfer) onto the peripheral surface of the intermediary transfer member 24, as voltage (primary transfer bias) opposite in polarity to the toner is applied to the cylinder portion of the intermediary transfer member 24.

The toner particles remaining on the peripheral surface of the photosensitive drum 1 after the completion of the primary transfer are removed by the cleaning means 6 to prepare the photosensitive drum 1 for the formation of a second latent image.

As soon as the completion of the first image, a process similar to the process carried out for the formation of the first image is sequentially repeated for forming the toner images of the second (magenta), third (cyan), and fourth (black) colors, sequentially placing thereby in layers the image formed of the magenta (M) toner, by developing the second latent image, image formed of the cyan (C) toner, by developing the third latent image, and image formed of the black (Bk) toner, by developing the fourth latent image, on the peripheral surface of the intermediary transfer member 24, yielding thereby a full-color image.

During the aforementioned "color interval", that is, the interval between a period in which an image is formed of toner of one color and the next period in which another image is formed of toner of another color, the developing means 22 carries out three tasks: it moves away from the photosensitive drum 1 to separate the development roller 8 from the photosensitive drum 1; it rotates the rotary 22*x* to position the developing apparatus to be used for the following image formation process, to the development position P1, or the position in which the development apparatus is closest to the photosensitive drum 1; it moves back to the development position to place the developing apparatus for the following image formation, in contact with the photosensitive drum 1.

After the full-color image is synthesized on the intermediary transfer member 24, of the plurality of monochromatic toner images, a transfer belt 18, which is kept away from the peripheral surface of the intermediary transfer member 24 up to this point in the operation, is placed in contact with the peripheral surface of the intermediary transfer member 24 with the application of a predetermined amount of pressure, and is rotationally driven. The transfer belt 18 is wrapped around a transfer roller 17. As voltage (secondary transfer bias) opposite in polarity to the toner is applied to the transfer roller 17, the plurality of monochromatic images formed in layers on the peripheral surface of the intermediary transfer member 24, of the toners different in color, are transferred all at once onto the surface of the transfer medium P which is delivered with a predetermined timing. After the transfer of the plurality of color toner images onto the transfer medium P, the transfer medium P is conveyed to a fixing apparatus 7, in which the plurality of color toner images are fixed to the transfer medium P, becoming a permanent full-color image. Then, the transfer medium P is discharged as a desired color print, from the image forming apparatus.

The toner particles remaining on peripheral surface of the intermediary transfer member 24 after the completion of the secondary transfer are removed by an intermediary transfer member cleaning means 16, which is placed in contact with the peripheral surface of the intermediary transfer member 24 with predetermined timing.

As described above, in the multicolor image formation process, each time a monochromatic image is completed, the rotary 22*x* is moved away from the photosensitive drum 1 by a predetermined distance, is rotated to move the developing apparatus, which is next, among the plurality of developing apparatuses 22*a*–22*d*, to be used for development, into the development position P1, in which the development roller 8 thereof can be placed in contact with the photosensitive drum 1, and is moved back toward the photosensitive drum 1. In other words, a developing apparatus in the development position P1 can be moved between the position in which the development roller thereof will be in contact with the photosensitive drum 1, and the position in which the development roller thereof will not be in contact with the photosensitive drum 1.

The image forming apparatus M in this embodiment also offers a secondary image formation mode in addition to the primary image formation mode, that is, the above described a full-color image formation mode. In the secondary image formation mode, a monochromatic image is formed, and the rotary 22*x* is not rotated. More specifically, one of the developing apparatuses, in particular, the developing apparatus 22*d*, is kept in the development position P1, in which the development roller 8 thereof can be placed in contact with the photosensitive drum 1, throughout an image forming operation.

Next, the monochromatic image formation process carried out when the image forming apparatus M is in the secondary image formation mode will be described.

In the monochromatic image formation process, the rotary 22*x* is not rotated during the periods in which no image is formed, that is, the intervals between the completion of the formation of one image and the beginning of the formation of the next image; in other words, the rotary 22*x* is not rotated during the so-called paper interval, that is, the interval between the formation of the n-th copy and the formation of the (n+1)-th copy. In essence, a plurality of copies are continuously made with the use of only the black developing apparatus 22*d*. Otherwise, the image formation steps: primary transfer step, secondary transfer step, cleaning step for image bearing member, and cleaning step for intermediary transfer member, carried out in the monochromatic image formation mode, or the secondary image formation mode, are the same as those carried out in the primary image formation mode, or the full-color image formation mode. Incidentally, the color of the toner used for forming a monochromatic image is not limited to black.

Theoretically, separating the developing means from the photosensitive drum with the predetermined timing and placing the developing means back in contact with the photosensitive drum with the predetermined timing, in the monochromatic image formation mode, as they are in the full-color image formation mode, wastes time by the length equal to the length of the time spent for rotating the rotary in the full-color mode; it unnecessarily lengthens the image formation time. In other words, not carrying out the step in which the developing means is separated from the photosensitive drum and then is placed back in contact with the photosensitive drum definitely reduces the time necessary for an operation for forming a plurality of monochromatic images. However, if this step is not carried out, the image bearing member remains in contact with the developer carrying member, causing the developer to deteriorate, more specifically, reducing the developer in the amount of the electrical charge it carries. As a result, such problem that the developer falls or scatters occurs.

Thus, in this embodiment, even in the monochromatic image formation mode, the above described step for temporarily separating the developing means 22, more specifically, the development roller 8*d*, from the photosensitive drum 1 and placing the development roller 8*d* back in contact with the photosensitive drum 1, is carried out during the paper intervals, although the time spent for the step is made shorter compared to that in the full-color image formation mode. As will be evident from the above description, once the black developing apparatus 22*d* is placed in the development position P1, it can be moved between the position in which the development roller 8*d* thereof will be in contact with the photosensitive drum 1 and the position in which the development roller 8*d* thereof will not be in contact with the photosensitive drum 1.

In this embodiment, the separation distance between the development roller 8 and photosensitive drum 1 means the shortest distance between the peripheral surface of the development roller 8 and the peripheral surface of the photosensitive drum 1, after the completion of the step for horizontally moving the developing means 22 comprising the rotary 22*x* away from the photosensitive drum 1; in other words, the separation distance is the shortest distance between the peripheral surface of the image bearing member and the peripheral surface of the developer carrying member in the development position P1, when the rotary 22*x* is not rotating.

Figure 3:
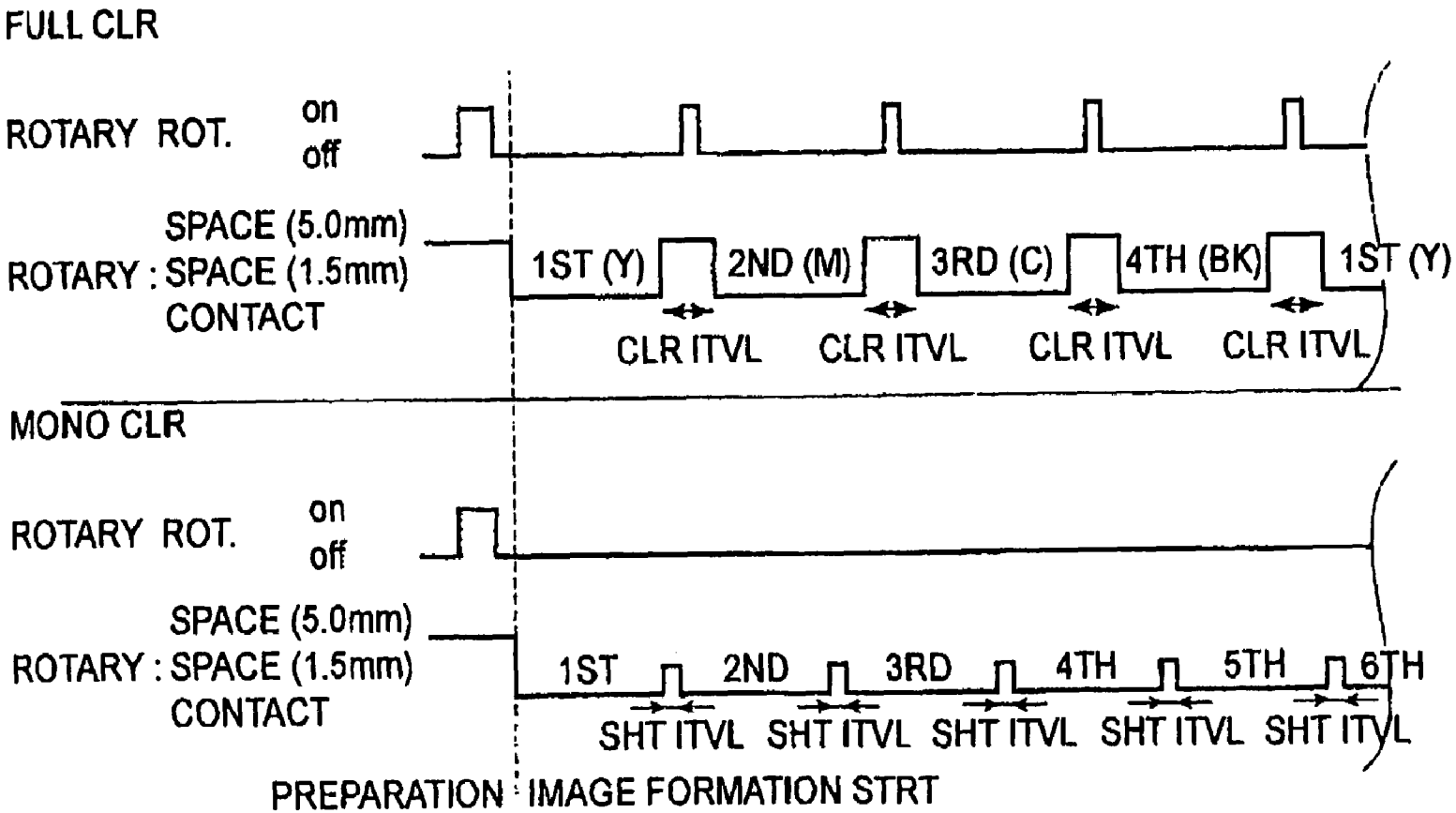
FIG. 3 is a timing chart showing an example of a set of the timing with which the rotary is rotated, the timing with which the rotary is placed in contact with the image bearing member, and the timing with which the rotary is separated from the image bearing member, in the primary image formation mode in the first embodiment of the present invention.

FIG. 3 is a timing chart of the rotational and horizontal movements of the rotary in this embodiment in the full-color and monochromatic image formation modes.

Referring to FIG. 3, in the full-color image formation mode, in the preparatory period, a selected developing apparatus is moved by rotation of the rotary 22*x* to the development position P1 in which it is used for development. Then, after the formation of the first image, the rotary 22*x* is horizontally moved during the color interval (while no image is actually formed), that is, before the following image formation process begins, so that the primary separation distance, that is, the separation distance between the image bearing member and the developer bearing member in the development position P1, becomes 5.0 mm. Then, the rotary 22*x* is rotated to move the next developing apparatus to the development position P1. Then, the rotary 22 is horizontally moved back toward the photosensitive drum 1 to place the development roller of the next developing apparatus in contact with the photosensitive drum 1.

In comparison, in the monochromatic image formation mode, in the preparatory period, a selected developing apparatus is moved by the rotation of the rotary 22*x* to the development position P1, in which it is used for development. Then, after the formation of the first image, the rotary 22*x* is horizontally moved, during the period corresponding to the paper interval in an operation in which a plurality of images are continuously formed, to a position in which the separation distance (secondary separation distance) between the image bearing member and developer carrying member in the development position P1 is 0.5 mm. Then, the rotary 22*x* is moved back toward the photosensitive drum to place the same development roller 8 in contact with the photosensitive drum, that is, without rotating the rotary 22*x*.

Thus, the time spent for moving the rotary 22*x* away from the photosensitive drum and moving back toward the photosensitive drum in the monochromatic image formation mode is shorter than that in the full-color image formation mode. In other words, with the provision of the above described operational arrangement, the image forming apparatus M is greater in output when it is in the monochromatic mode than when it is in the full-color mode.

Table 1 is the summary of the problems which occurred at various separation distances in the full-color and monochromatic image formation modes. In the table, G indicates that images were excellent; F indicates that a small amount of scattered toner particles was visible; and NG indicates that the drum was damaged; the paper intervals could to be significantly reduced; the toner deteriorated; etc.

TABLE 1

| | GAP (COLOR, SHEET) [mm] | | | | | | | | |
|---|---|---|---|---|---|---|---|---|---|
| | 0 | 0.1 | 0.3 | 0.5 | 1.0 | 1.5 | 2.0 | 3.0 | 5.0 |
| FULL CLR | — | NG | NG | NG | NG | NG | NG | G | G |
| MONO CLR | NG1 | F | F | G | G | G | NG2 | NG2 | NG2 |

G: GOOD
F: FAIR (SLIGHT TONER SCATTERING)
NG: DRUM DAMAGE
NG1: TONER DETERIORATION
NG2: INSUFFICIENT SHEET INTERVAL REDUCTION

As shown in Table 1, in the full-color image formation mode, unless the developing means was moved away from the photosensitive drum 1 so that the separation distance became 3.0 mm, the developing means 22 came into contact with the photosensitive drum 1, while the rotary 22*x* was rotated. As a result, defective images were produced; for example, images suffering from the fog attributable to drum damage, images suffering from soiling attributable to the contact, etc.

In the monochromatic image formation mode, the rotary 22*x* was not rotated during the paper intervals. Therefore, no image suffering from the defects attributable to drum damage was produced. However, when the separation distance was made to be no less than 2.0 mm, the paper intervals could not be reduced in length enough to significantly increase the output per unit of time of the image forming apparatus M compared to the output thereof in the full-color image formation mode.

Also in the monochromatic image formation mode, when the separation distance was made to be no more than 0.1 mm (virtually no separation), the paper intervals were significantly reduced. But when the apparatus M was continuously used for a long time, the toner fell and/or scattered, soiling the transfer roller 17 and transfer medium P, due to the toner deterioration. When the separation distance was made to be no less than 0.1 mm and no more than 0.5 mm, the toner scattered across the adjacencies of the development roller 8*d*, by an amount not large enough to result in the formation of defective images.

The cause for the aforementioned toner deterioration is thought to be as follows. That is, when the distance by which the developing apparatus 22*d* is separated from the photosensitive drum 1 is smaller than a certain value, the toner on the development roller 8*d* is always in contact with the photosensitive drum 1. As a result, the toner on the development roller 8*d* is deteriorated by the friction between the photosensitive drum 1 and development roller 8*d*, compared to when the development roller 8*d* is completely separated from the photosensitive drum 1. Further, continuously using the image forming apparatus M results in the further deterioration of the toner. In this embodiment, the thickness of the toner layer formed on the development roller 8*d* is roughly 0.05 mm.

As for the scattering of the toner, which also occurs when the separation distance is insufficient, the toner is thought to scatter from the development roller 8*d*, because the charged toner is in the extreme proximity of the electric field of the photosensitive drum 1. Incidentally, in this embodiment, during the paper intervals, the potential levels of the photosensitive drum 1 and development bias are 0 V, and the development roller 8*d* is continuously driven even while the development roller 8*d* is kept separated from the photosensitive drum 1. The amount of the electrical charge the toner carries is −80 μC/g.

Thus, in the case of the monochromatic image formation mode, as long as the separation distance is made to be no less than 0.5 mm, it is assured that the development roller 8*d* can be kept completely separated from the photosensitive drum 1, in spite of the presence of a certain amount of dimensional error unavoidable in the manufacture of a color image forming apparatus of the rotary type.

Based on the numbers in Table 1, in this embodiment, the rotary separation distance in the full-color image formation mode is made to be no less than 3.0 mm, and the rotary separation distance in the monochromatic image formation mode is made to be in the range of 0.1–1.5 mm, although it is preferable that the rotary separation distance in the monochromatic image formation mode is no less than 0.5 mm. The separation distance may be varied according to the shape of the developer container. Further, the largest separation distance in the monochromatic mode does not need to be limited to 1.5 mm; it is optional. In other words, it may be selected according to the desired output speed.

As described above, in this embodiment of the present invention, the color image forming apparatus of the rotary type is structured so that even when the apparatus is in the monochromatic image formation mode, the rotary is moved to separate the development roller 8 from the photosensitive drum 1 and place the development roller 8 again in contact with the photosensitive drum 1, during the periods corresponding to the paper intervals, and also so that the separation distance in the monochromatic image formation mode becomes smaller than that in the full-color image formation mode. Further, the separation distance between the image bearing member and the development roller in the monochromatic image formation mode is made to be no less than the thickness of the toner layer borne on the development roller. Further, the separation distance of the developing means in the monochromatic image formation mode is desired to be no less than 500 μmm. Further, the length of time the separation distance is kept at 0.5 mm in the monochromatic image formation mode is made to be shorter than the length of time the separation distance is kept at 5.0 mm in the full-color image formation mode. Further, the thickness of the toner layer borne on the development roller is the same whether the image forming apparatus is in the full-color image formation mode or monochromatic image formation mode.

When continuously forming a plurality of monochromatic images in the monochromatic image formation mode, it is desired that the separation distance between the portion of the peripheral surface of the image bearing member, corresponding to the pre-rotation period (FIG. 3), more specifically, the pre-rotation period immediately prior to the formation of the first image, in which no image is formed, and the development roller, and the separation distance between the portion of the peripheral surface of the image bearing member, corresponding to the post-rotation period (FIG. 3), more specifically, the period immediately after the formation of the last image, in which no image is formed, and the development roller, are made smaller than the separation distance between the portion of the peripheral surface of the image bearing member, corresponding to the paper intervals, that is, the periods between the formation of one image and the formation of the following image, and the development of the roller. In this embodiment, the separation distance corresponding to the paper intervals is set to 5.0 mm, as shown in FIG. 3.

With the provision of the above described structural arrangement, it is possible to reduce the length of the time in which no image is formed in the monochromatic image formation mode in order to increase the output per unit of time of the image forming apparatus. Further, it is possible to prevent the rotation of the rotary from causing the image bearing member to come into contact with the development roller when the image forming apparatus is in the multicolor image formation mode. Moreover, it is possible to prevent the scattering of the toner, and the falling of the toner attributable to toner deterioration. Therefore, it is possible to provide an image forming apparatus capable of forming an excellent image.

The present invention does not limit the color, type, number, etc., of the developer to be stored in the developer container(s) of the above described image forming apparatus, nor the shape of the developer container(s), the number of the stirring members to be placed in the developer container(s), etc.

Also in this embodiment, the development roller is desired not to be driven when the distance between the image bearing member and development roller has been increased (to primary separation distance) to more effectively prevent the toner deterioration. On the other hand, when the distance between the image bearing member and development roller has been reduced (to secondary separation distance) as in the monochromatic mode, the rotation of the development roller is desired not to be stopped, that is, it is desired to be continued, because it requires a certain length of time to control the rotation of the development roller, after the stationary development roller begins to be rotated.

Obviously, during such a non-development period as the color interval and paper interval, the rotation of the image bearing member and intermediary transfer member is not stopped (they are kept rotating), because such a non-development period is one of the sequential steps of an image forming operation.

A command for switching between the full-color image formation mode and monochromatic image formation mode may be inputted through a computer or the like connected to the image forming apparatus, or the control panel of the image forming apparatus, as has been known.

Embodiment 2

Next, the second embodiment of the present invention will be described in detail with reference to FIG. 4. The portions of the image forming apparatus in this embodiment identical to those in the first embodiment will be given the same referential symbols as those given in the description of the first embodiment, and will not be described here.

Figure 4:
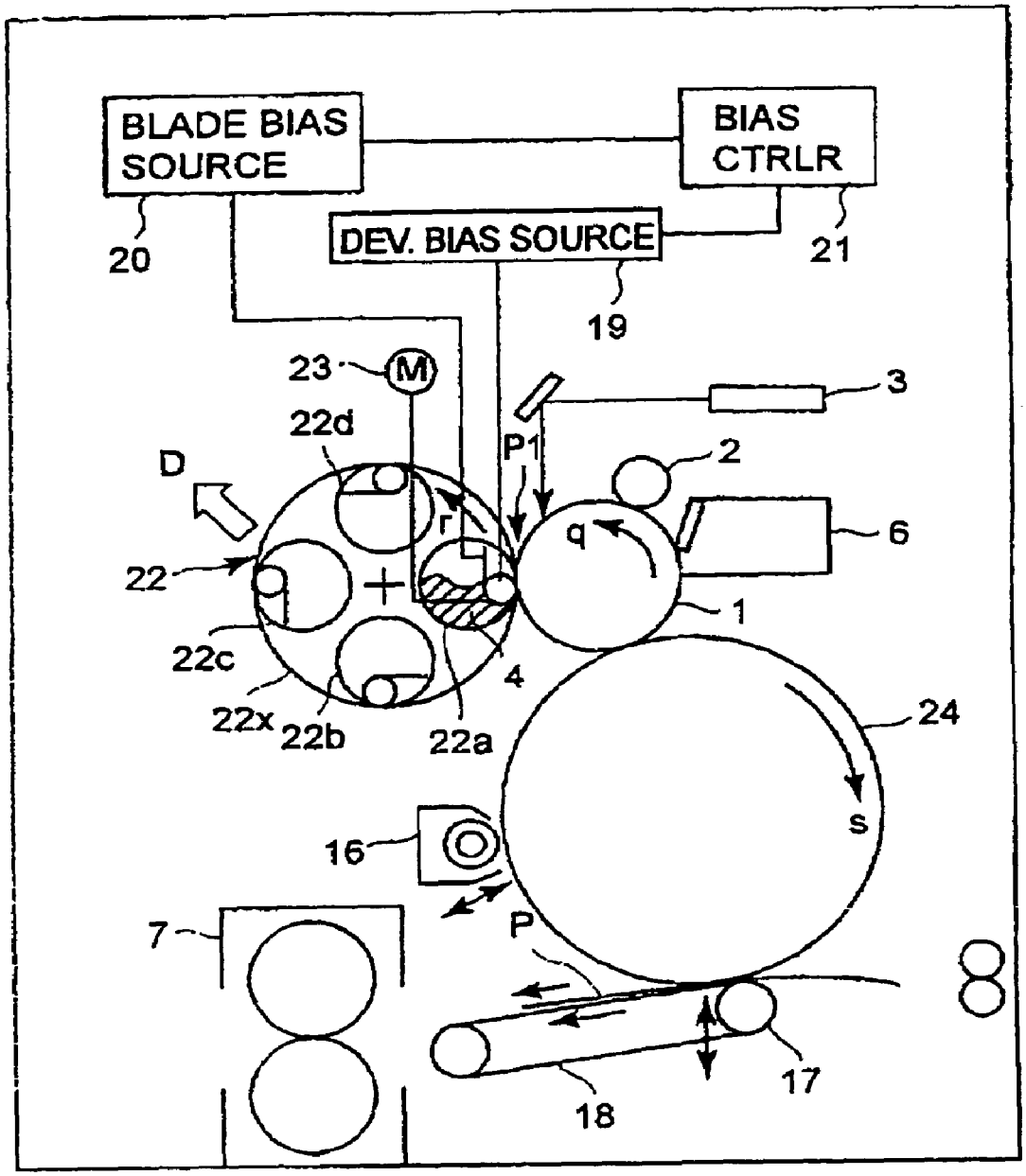
FIG. 4 is a schematic sectional view of the image forming apparatus in another preferred embodiment of the present invention.

Referring to FIG. 4, the image forming apparatus in this embodiment is provided with a development bias power source 19, a regulation (blade) bias power source 20, and a bias control portion 21, in addition to the structural components with which the image forming apparatus in the first embodiment is provided. The development bias power source 19 is a bias applying means for applying bias to the development rollers 8 of the developing apparatuses 22*a*, 22*b*, 22*c*, and 22*d*. The blade bias power source is a bias applying means for applying bias to the development blades 9 of the developing apparatuses 22*a*, 22*b*, 22*c*, and 22*d*. The bias control portion 21 controls the timings with which bias is applied from the development bias power source 19 and blade bias power source 20.

The structures of the developing apparatuses 22*a*–22*d* are the same as those shown in FIG. 2.

Compared to the image forming apparatus in the first embodiment shown in FIG. 1, the image forming apparatus in this embodiment is characterized in that it is provided with the bias applying means 19 and 20 for applying bias to the development rollers 8 as developer carrying members, and the development blades 9 as developer regulating members, respectively, in order to provide the potential difference between the development roller 8 and development blade 9, with a predetermined timing, while development roller 8 is rotated without being used for development; more specifically, the potential difference between the development roller 8 and development blade 9 during the period in which no image is developed is made greater than that during the period in which an image is developed.

Figure 5:
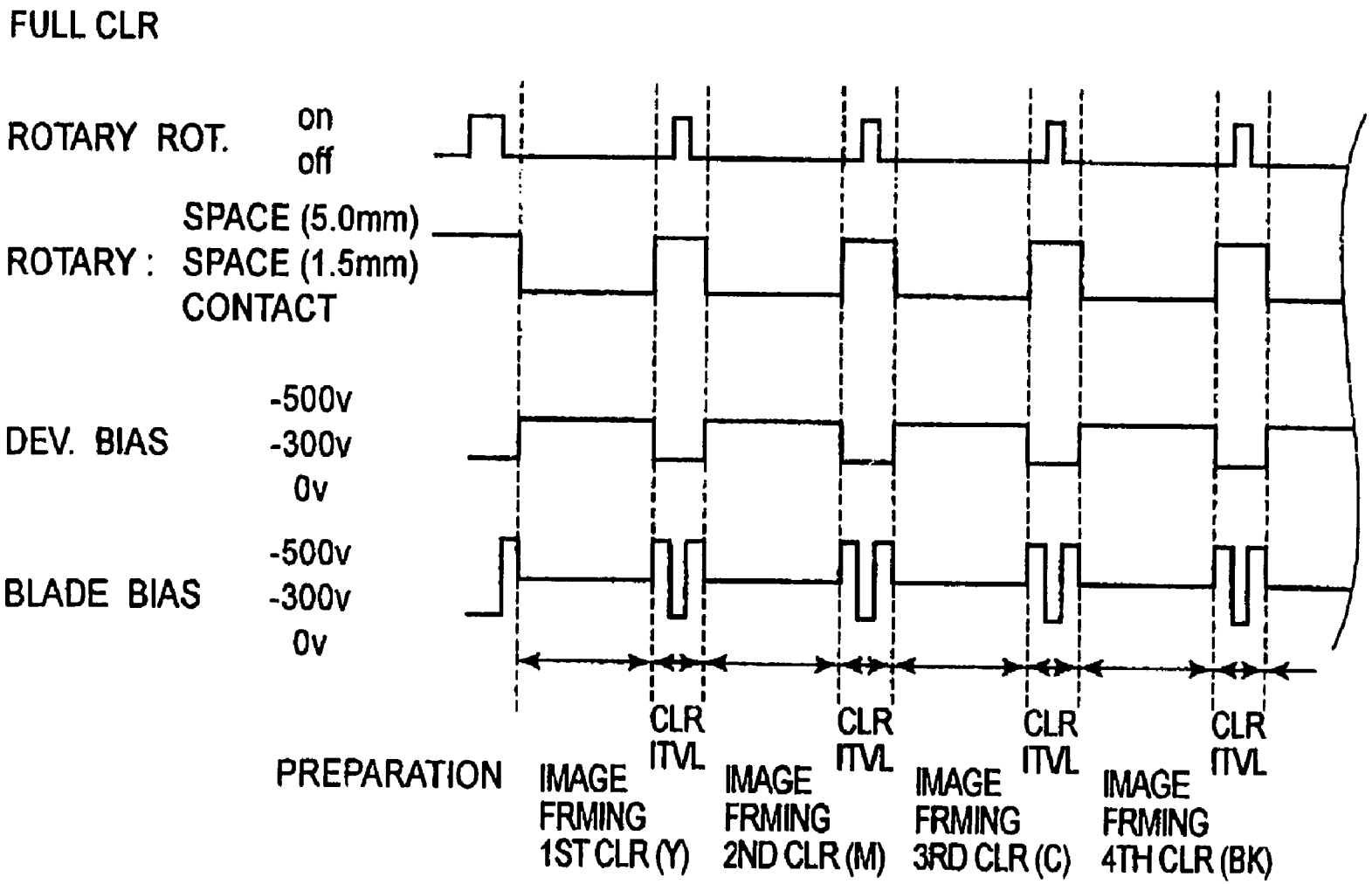
FIG. 5 is a timing chart showing an example of the set of the timing with which the rotary is rotated, the timing with which the rotary is placed in contact with the image bearing member, the timing with which the rotary is separated from the image bearing member, the timing with which the development bias power source is turned on, and the timing with which the blade bias power source is turned on, in the primary image formation mode in the second embodiment of the present invention.
Figure 6:
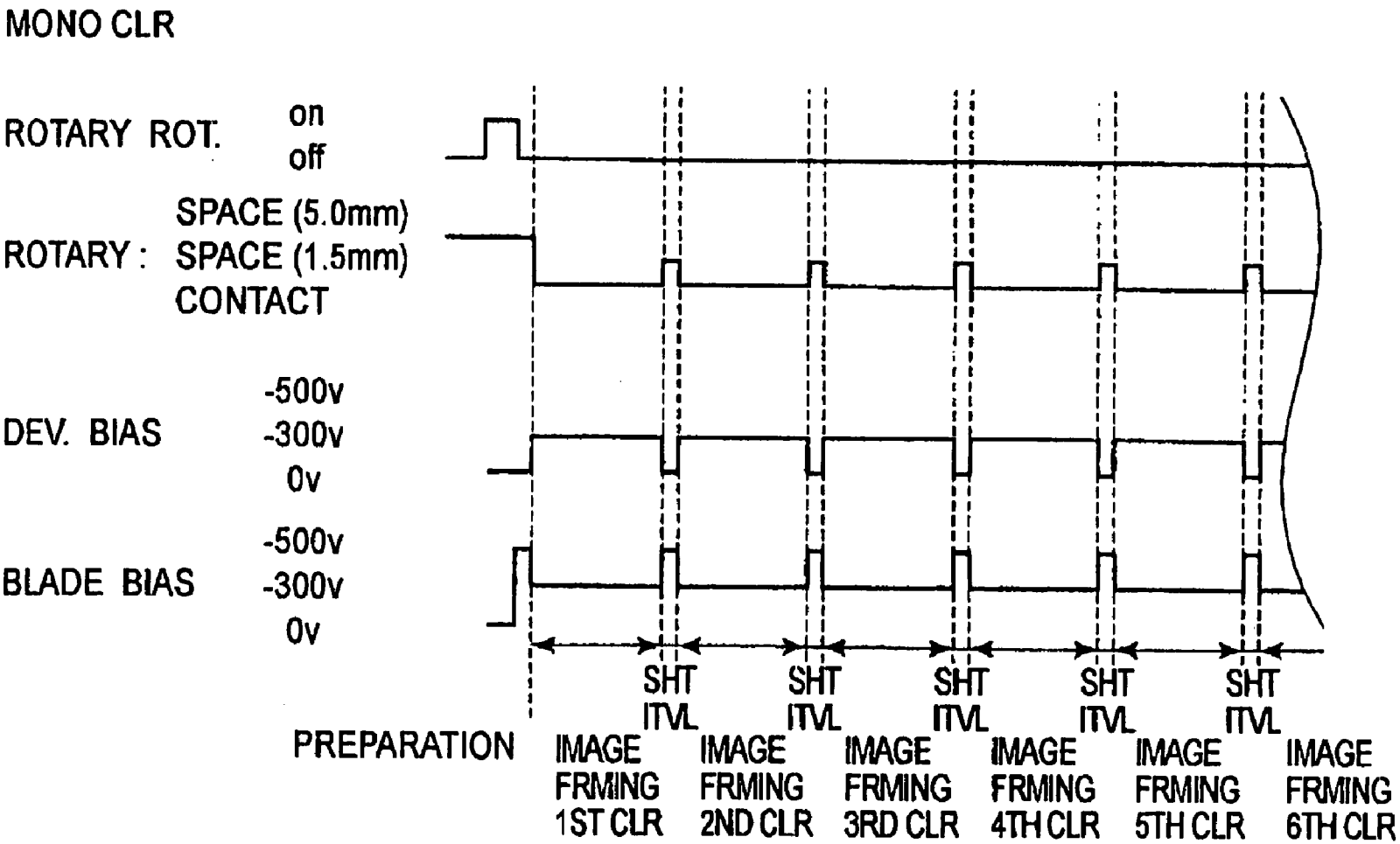
FIG. 6 is a timing chart showing an example of the set of the timing with which the rotary is rotated, the timing with which the rotary is placed in contact with the image bearing member, the timing with which the rotary is separated from the image bearing member, the timing with which the development bias power source is turned on, and the timing with which the blade bias power source is turned on, in the secondary image formation mode in the second embodiment of the present invention.

FIG. 5 is a diagram showing the development sequence carried out by the image forming apparatus in this embodiment when it is in the primary image formation mode, or the full-color image formation mode. FIG. 6 is a diagram showing the development sequence carried out by the image forming apparatus in this embodiment when it is in the secondary image formation mode, or the monochromatic image formation mode.

In the full-color image formation mode shown in FIG. 5, during the preparatory periods, and so-called color intervals, in which no image is formed, −500 V and 0 V are applied to the development blade 9*a* and development roller 8*a* from the blade bias power source 20 and development bias power source 19, respectively, creating thereby a potential difference of 500 V between the development blade 9*a* and development roller 8*a*.

In comparison, while an image is formed, that is, while an image is developed, −300 V is applied from both the development bias source 19 and blade bias power source 20, creating no potential difference between the development blade 9*a* and development roller 8*a*. In other words, in this embodiment, the potential difference between the development bias and blade bias while no image is developed (which hereinafter will be referred to as "non-development period") is made greater than that while an image is developed (which hereinafter will be referred to as "development period").

The controls executed to rotate the rotary 22*x*, separate the rotary 22*x* from photosensitive drum 1, or placing the rotary 22*x* in contact with the photosensitive drum 1 are the same as those executed when the image forming apparatus in the first embodiment is in the full-color image formation mode. Further, the amount by which the toner is made to carry electrical charge is made to be the same as that in the first embodiment, which is −80 μC/g.

The purpose of providing a potential difference between the voltages applied from the development bias power source 19 and blade bias power source 20 is to prevent the electrostatically agglomerated toner particles and the minute particles added to the toner from adhering to the development blade 9*a*.

To describe in more detail, if the bias applied to the development roller 8 is made roughly the same in potential as the bias applied to the development blade 9, or a potential difference is provided between the development roller 8 and development blade 9, but is kept the same whether during the development period or non-development period, some of the toner particles and the minute particles added to the toner adhere to the development blade 9 due to the nonuniformity in the amount of the electrical charge they carry, disturbing thereby the toner layer on the development roller 8, which in turn results in the formation of a streaky image. In order to prevent this problem, during the development periods, the potential difference is not provided between the development blade 9 and development roller 8, whereas during the non-development periods, the potential difference is provided between the development blade 9 and development roller 8 to electrostatically adhere the toner particles and the minute particles having adhered to the development blade 9, to the development roller 8 in order to clean the development blade 9. It should be noted here that providing the potential difference between the development blade 9 and development roller 8 by making the potential of the development blade 9 closer to the potential of the toner than the potential of the development roller 8 enhances the cleaning performance. With the provision of the above described arrangement, it is possible to form excellent images for a long period of time.

The potential difference to be provided between the development blade and development roller during the non-development periods does not need to be limited to the above described one; it may be optionally set within the range of 60–600 V. Further, the frequency at which the potential difference is to be provided, and the timing with which the potential difference is provided, also do not need to be limited to the above described ones.

In comparison, when the image forming apparatus is in the secondary image formation mode, that is, the monochromatic image formation mode, the sequence shown in FIG. 6 is carried out. That is, during the preparatory period, and the non-development periods called paper intervals, −500 V and 0 V are applied to the development blade 9 and development roller 8 from the blade bias power source 20 and development bias power source 19, respectively, as in the full-color image formation mode.

Also in this case, during the development periods, −300 V is applied from the development bias power source 19 and blade bias power source 20, keeping thereby the development roller 8 and development blade 9 at roughly the same potential level. The controls executed to rotate the rotary 22*x*, separate the development roller 8 from the photosensitive drum 1, and place the development roller 8 in contact with the photosensitive drum 1 are the same as those executed when the image forming apparatus in the first embodiment is in the monochromatic image formation mode. With the provision of the above described arrangement, the adhesion of the toner particles and the minute particles in the toner to the development blade 9 can be prevented as in the full-color mode, making it possible to form excellent images for a long period of time.

If bias is applied to the development blade 9 from the blade bias power source 19 during the paper intervals in the monochromatic image forming mode, there is a possibility that the adhesion of developer to the unintended points on the peripheral surface of the photosensitive drum 1, which results in the formation of a foggy image, will occur, although it depends on the separation distance of the rotary 22*x*. Table 2 shows the effects of the changes in the separation distance of the rotary in this embodiment. In the table, G indicates that images were excellent; F indicates that a small amount of fog, and a small amount of scattered toner particles were visible; and NG indicates the occurrences of such problems that fog was generated; the paper intervals could not be significantly reduced in length; and the toner deteriorated.

TABLE 2

| | GAP (COLOR, SHEET) [mm] | | | | | | | | |
|---|---|---|---|---|---|---|---|---|---|
| | 0 | 0.1 | 0.3 | 0.5 | 1.0 | 1.5 | 2.0 | 3.0 | 5.0 |
| FULL CLR | — | NG | NG | NG | NG | NG | NG | G | G |
| MONO CLR | NG3 | F2 | F2 | G | G | G | NG4 | NG4 | NG4 |

G: GOOD
F: FAIR (FOG AND TONER SCATTERING)
NG: DRUM DAMAGE
NG3: TONER DETERIORATION AND FOG
NG4: INSUFFICIENT SHEET INTERVAL REDUCTION

According to Table 2, in the full-color mode, development fog did not occur because the developing apparatuses 22*a*–22*d* were switched by rotating the rotary 22*x*. However, when the separation distance was no more than 3.0 mm, the developing means 22 came in contact with the photosensitive drum 1, damaging thereby the photosensitive drum 1.

Also according to Table 2, when the rotary 22*x* was not separated from the photosensitive drum 1 by a sufficient distance during the paper intervals in the monochromatic image formation mode, some toner particles fell from the development roller 8 due to deterioration, and fog was formed on the photosensitive drum 1 by the application of the blade bias. As a result, the transfer roller 17 and/or transfer medium P were soiled. However, even when the rotary 22*x* was separated from the photosensitive drum 1 by a distance in the range of 0.1–0.3 mm, fog was created, but only by an amount too small to be conspicuous, and also the toner scattered, but also only by an amount too small to be conspicuous. This occurred because the application of the blade bias during the paper intervals added to the force which acted in the direction to transfer the toner onto the photosensitive drum 1. However, when the rotary 22*x* was separated from the photosensitive drum 1 by no less than 0.5 mm in consideration of the errors in the dimensions of the mechanical components of the image forming apparatus, the above described problems did not occur.

It is evident from the results shown in Table 2 that in the case of the image forming apparatus in this embodiment, the primary separation distance, or the distance by which the rotary 22*x* is to be separated from the photosensitive drum 1 in the full-color mode, is desired to no less than 3.0 mm, whereas the secondary separation distance, or the distance by which the rotary 22*x* is to be separated from the photosensitive drum 1 in the monochromatic mode, is desired to be no less than 0.5 mm.

The separation distance in the full-color mode may be adjusted in accordance with the shape, or the like, of the developer container(s). Further, the separation distance in the monochromatic mode is also optional; it may be freely selected in accordance with the desired output speed.

As described above, in this embodiment, the image forming apparatus of the rotary type is provided with the bias applying means 19 and 20 for applying bias to the development roller 8 as a developer carrying member, and the development blade 9 as a developer regulating member, respectively, to provide a potential difference between the development roller 8 and development blade 9 during a part of each of the non-development periods, and the rotary 22*x* of the image forming apparatus is separated from the photosensitive drum 1 by the secondary separation distance smaller than the primary separation distance, that is, the distance by which the rotary 22*x* is separated from the photosensitive drum in the full-color formation mode, and placed back in contact with the photosensitive drum 1 during the paper intervals when the apparatus is in the monochromatic image formation mode. Further, the secondary separation distance, that is, the separation distance of the developing means 22 in the monochromatic image formation mode is made to be no less than the thickness of the toner layer borne on the development roller 8*d*. The separation distance of the developing means 22 in the monochromatic image formation mode is desired to be no less than 500 μm.

With the provision of this structural arrangement, it is possible to reduce in length the non-development periods in the monochromatic image formation mode, making it therefore possible to increase the image output speed. Further, it is possible to prevent the rotation of the rotary from causing the developing means to come into contact with the image bearing member while the rotary is rotated when the image forming apparatus is in the multicolor (or full-color) image formation mode. Further, it is possible to prevent the toner from scattering, prevent the toner from falling due to deterioration, and prevent the problem that the toner adheres to the development blade and gradually accumulates thereon throughout the service life of the apparatus. Therefore, it is possible to provide an image forming apparatus capable of always forming an excellent image.

Embodiment 3

Next, the third embodiment of the present invention will be described.

Figure 7:
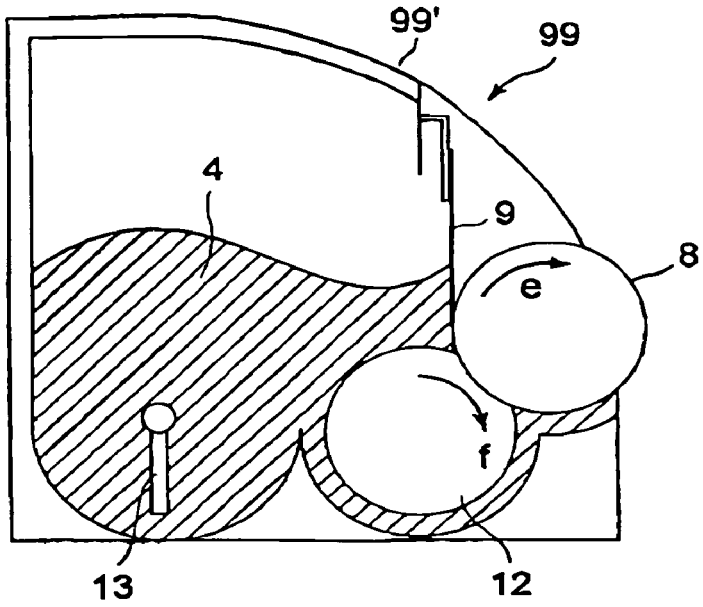
FIG. 7 is a schematic sectional view of a development cartridge in accordance with the present invention.
Figure 8:
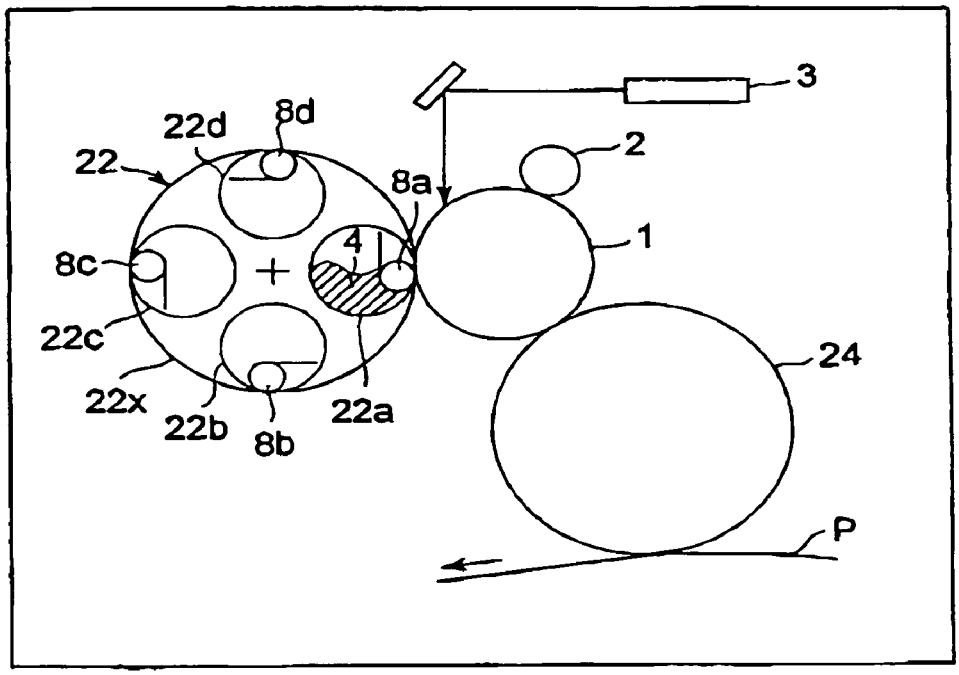
FIG.8 PRIOR ART
FIG. 8 is a schematic sectional view of a typical image forming apparatus in accordance with the prior art, showing the general structure thereof.

FIG. 7 is a sectional view of the cartridge in this embodiment.

The elements of this cartridge, which are the same as those of the cartridge in the first embodiment will be given the same referential symbols as those given for the description of the first embodiment, and will not be described.

This embodiment is characterized in that each of the developing apparatuses 22*a*, 22*b*, 22*c*, and 22*d*, similar in structure as those in the first and second embodiments, is disposed in a cartridge 99', creating thereby a development cartridge 99 removably mountable in the main assembly of the image forming apparatus in accordance with the present invention.

The cartridge 99 shown in the drawing comprises: the toner 4, development roller 8, development blade 9, supply roller 12, stirring member 13, and a cartridge in which the preceding components are integrally disposed.

In this embodiment, four types of cartridges 99 are prepared, which are different in the color of the toner to be stored therein, and are removably mountable in the image forming apparatuses in the first and second embodiments. Therefore, this embodiment makes it possible to provide an image forming apparatus which not only does not suffer from the scattering of toner, falling of toner attributable to toner deterioration, adhesion and gradual accumulation of toner to the development blade throughout the service life of the apparatus, and the like problems, being therefore capable of forming an excellent image, but also is superior in usability and maintenance.

As described above, according to the present invention, the secondary separation distance, that is, the distance by which the developer carrying member is moved away from the image bearing member during the paper intervals in the secondary image formation mode is made smaller than the primary separation distance, that is, the distance by which the developer carrying member is moved away from the image bearing member during the color intervals in the primary image formation mode, reducing thereby the non-development time in the secondary image formation mode. Therefore, the application of the present invention can improve an image forming apparatus in performance. Also according to the present invention, when a plurality of developing apparatuses are moved to the development position in the primary image formation mode, they are prevented from coming into contact with the image bearing member. Also according to the present invention, development fog is always prevented, making it possible to always form an excellent image.

Also according to the present invention, an image forming apparatus is provided with the developer regulating member for regulating the amount by which developer is allowed to remain on the developer carrying member, and the bias applying means for applying bias to the developer carrying member and developer regulating member, and is structured so that the potential difference between the developer carrying member and developer regulating member is increased during the non-development periods. Therefore, a problem that an image suffering from development streaks and the like is formed when the image forming apparatus is operated in the primary image formation mode does not occur. In other words, the present invention makes it possible to provide an image forming apparatus capable of forming excellent images for a long period of time.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a plurality of developing devices for developing electrostatic images formed on said image bearing member with developers, said developing devices including respective developer carrying members for carrying respective developers;

moving means for moving a selected one of said developing devices to an operative position, wherein each of said developer carrying members is movable selectively to be in contact with or spaced from said image bearing member at the operative position;

wherein said apparatus is operable in a first image formation mode in which an image is formed using said plurality of developing devices and a second image formation mode in which an image is formed using one of said plurality of developing devices, and wherein said developer carrying member which is at the operative position in the first image formation mode is capable of being spaced from said image bearing member by a first distance during a non-developing-operation, and said developer carrying member which is at the operative position in the second image formation mode is capable of being spaced from said image bearing member by a second distance during the non-developing-operation, and wherein the second distance is smaller than the first distance.

2. An apparatus according to claim 1, wherein a duration in which said developer carrying member is spaced from said image bearing member by the second distance is shorter than the duration in which said developer carrying member is spaced from said image bearing member by the first distance.

3. An apparatus according to claim 1 or 2, wherein when the image is formed in the first image formation mode, said developing devices are sequentially moved to the operative position.

4. An apparatus according to claim 3, wherein when the image is formed in the second image formation mode, said one of the developing devices is not moved from the operative position.

5. An apparatus according to claim 1 or 2, wherein each time one of said developing devices is moved to the operative position in the first image formation mode, said developer carrying member disposed at the operative position is spaced from said image bearing member.

6. An apparatus according to claim 1 or 2, wherein said developer carrying member which is placed at the operative position is spaced from said image bearing member each time a non-image region between adjacent images which are continuously formed on said image bearing member passes by said developer carrying member.

7. An apparatus according to claim 1 or 2, wherein when a plurality of the .images are continuously formed on said image bearing member in the second .image formation mode, a distance by which said developer carrying member is spaced from said image bearing member corresponding to a non-image region between adjacent images is smaller than a distance by which said developer carrying member is spaced from said image bearing member corresponding to a non-image region before a first one of the continuous images.

8. An apparatus according to claim 1 or 2, wherein the second distance is larger than a thickness of a layer of the developer carried on said developer carrying member.

9. An apparatus according to claim 1 or 2, wherein the second distance is not less than 500 μm.

10. An apparatus according to claim 1 or 2, wherein when said developer carrying member is spaced from said image bearing member by the first distance, rotation of said developer carrying member can be stopped.

11. An apparatus according to claim 10, wherein when said developer carrying member is spaced from said image bearing member by the second distance, said developer carrying member remains rotating.

12. An apparatus according to claim 1 or 2, wherein each of said developing devices includes a regulating member for regulating an amount of the developer carried on said developer carrying member, and a potential difference between said developer carrying member and said regulating member is larger when said developer carrying member is spaced from said image bearing member than when said developer carrying member is contacted to said image bearing member.

13. An apparatus according to claim 1 or 2, wherein said moving means includes a rotatable member supporting said developing devices, and rotatable member rotates to move the selected one of said developing devices to the operative position.

14. An apparatus according to claim 13, wherein said developer carrying member is contacted to or spaced from said image bearing member at the operative position by changing a distance between said image bearing member and said rotatable member.

15. An apparatus according to claim 1 or 2, wherein at least one of developing devices is detachably mountable relative to a main assembly of said image forming apparatus.

16. An apparatus according to claim 1 or 2, wherein at least one of developing devices is detachably mountable relative to said rotatable member.

17. An apparatus according to claim 1 or 2, wherein the image formed in the first image formation mode is a full-color image, and the image formed in the second image formation mode is a monochromatic image.

18. An image forming apparatus comprising:

an image bearing member;

a plurality of developing devices for developing electrostatic images formed on said image bearing member with developers, said developing devices including respective developer carrying members for carrying respective developers;

moving means for moving a selected one of said developing devices to an operative position, wherein each of said developer carrying members is capable of selectively contacting the developer carried thereon to said image bearing member or spacing the developer carried on said developer carrying member from said image bearing member at the operative position;

wherein said apparatus is operable in a first image formation mode in which an image is formed using said plurality of developing devices and a second image formation mode in which an image is formed using one of said plurality of developing devices, and wherein the developer carried on said developer carrying member which is at the operative position in the first image formation mode is capable of being spaced from said image bearing member by a first distance during a non-developing-operation, and the developer carried on said developer carrying member which is at the operative position in the second image formation mode is capable of being spaced from said image bearing member by a second distance during the non-developing-operation, and wherein the second distance is smaller than the first distance.

19. An apparatus according to claim 18, wherein a duration in which the developer carried on said developer carrying member is spaced from said image bearing member by the second distance is shorter than the duration in which the developer carried on said developer carrying member is spaced from said image bearing member by the first distance.

20. An apparatus according to claim 18 or 19, wherein when the image is formed in the first image formation mode, said developing devices are sequentially moved to the operative position.

21. An apparatus according to claim 20, wherein when the image is formed in the second image formation mode, said one of the developing devices is not moved from the operative position.

* * * * *

UNITED STATES PATENT AND TRADEMARK OFFICE

CERTIFICATE OF CORRECTION

PATENT NO. : 7,068,966 B2
APPLICATION NO. : 10/775082
DATED : June 27, 2006
INVENTOR(S) : Shinohara et al.

It is certified that error appears in the above-identified patent and that said Letters Patent is hereby corrected as shown below:

On the title page
At Item (56) FOREIGN PATENT DOCUMENTS:
"JP 62-251772 2/1987" should read --JP 62-251772 11/1987--.

COLUMN 17:
Line 7, "as" should read --to--.

COLUMN 18:
Line 56, ".images" should read --images--.

Signed and Sealed this

Fifth Day of February, 2008

JON W. DUDAS
*Director of the United States Patent and Trademark Office*